United States Patent [19]

Obman et al.

[11] Patent Number: 4,643,401

[45] Date of Patent: Feb. 17, 1987

[54] APPARATUS FOR COOLING A VACUUM FURNACE

[75] Inventors: Howard J. Obman, Telford; Howard D. Brodbeck, Berwyn, both of Pa.

[73] Assignee: MG Industries, Valley Forge, Pa.

[21] Appl. No.: 770,074

[22] Filed: Aug. 28, 1985

[51] Int. Cl.[4] ..... C21N 11/00

[52] U.S. Cl. ..... 266/80

[58] Field of Search ..... 266/78, 80, 82, 87, 266/90, 88, 89, 250, 259

[56] References Cited

U.S. PATENT DOCUMENTS

| | | | |
|---|---|---|---|
| 3,002,735 | 10/1961 | Baker | 266/250 |
| 3,025,044 | 3/1962 | Giler | 266/250 |
| 3,219,331 | 11/1965 | Ipsen | 266/250 |
| 3,301,541 | 1/1967 | Ipsen | 266/250 |
| 3,302,939 | 2/1967 | Scharbrough | 266/81 |
| 3,522,357 | 7/1970 | Pine | 373/112 |
| 3,565,410 | 2/1971 | Scherff | 266/250 |
| 3,778,043 | 12/1973 | Busch | 266/87 |
| 3,820,766 | 6/1974 | Limque | 266/130 |
| 3,860,222 | 1/1975 | Tennenhouse | 266/250 |
| 4,022,446 | 5/1977 | Smith | 266/252 |
| 4,171,126 | 10/1979 | Zahn | 266/250 |
| 4,239,484 | 12/1980 | Schuster | 432/77 |
| 4,395,832 | 8/1983 | Jones | 34/233 |
| 4,515,645 | 5/1985 | Böhm | 148/16 |

FOREIGN PATENT DOCUMENTS

| | | | |
|---|---|---|---|
| 252968 | 1/1963 | Australia | 266/250 |
| 129701 | 1/1985 | European Pat. Off. | 266/250 |

OTHER PUBLICATIONS

"The Cryogenic Rapid Cooling Process" by Werner Buecker, Sep. 18, 1984.

*Primary Examiner*—Christopher W. Brody
*Attorney, Agent, or Firm*—William H. Eilberg

[57] ABSTRACT

A vacuum furnace is cooled in a two-step process. In the first step, a noble gas is injected into the furnace to break the vacuum, and to provide initial cooling. In the second step, a non-noble, but relatively inert, gas is injected into the furnace to complete the cooling. The flow of the noble gas is cut off when the temperature in the furnace falls below the point at which the contents of the furnace will no longer react with the second gas. The invention also discloses apparatus for cooling the furnace. Temperature controllers monitor the temperature, and rate of temperature change, in the furnace, and direct controlled amounts of noble or non-noble gas into the furnace. At no time is a liquefied gas allowed to enter the furnace. The process allows the furnace to be cooled rapidly but safely, minimizing the danger of thermal shock to the internal furnace components.

20 Claims, 4 Drawing Figures

APPARATUS FOR COOLING A VACUUM FURNACE

BACKGROUND OF THE INVENTION

The present invention relates to the field of high-temperature vacuum furnaces, and provides a method and apparatus for rapid and safe cooling of such a furnace.

Vacuum furnaces are well known in the art, and are used for heat treating of articles at very high temperatures, of the order of 2000° F. or higher. Vacuum furnaces have been used for many different kinds of heat treatment of metallic objects, such as bright hardening, annealing, sintering, and brazing, and other purposes. At the high temperatures required for such processes, the components being treated are very prone to chemical reaction and oxidation, necessitating a non-reactive furnace atmosphere.

Vacuum furnaces can be configured for continuous operation, or as batch-type furnaces. In the former case, the material to be heat treated is passed through the furnace on a conveyor means; in the latter, the material is placed in the furnace and heated, and then the furnace is cooled together with its contents. The present invention is primarily concerned with batch-type vacuum furnaces.

A perennial problem in the operation of vacuum furnaces has been in the cooling step. Because the temperature in the furnace is so high, a long time is required to bring the temperature down. When one attempts to accelerate the cooling process by injecting a cold liquid into the furnace, the sudden contact with the cold liquid can cause thermal shock, and warp or otherwise damage the contents of the furnace. A slight mistake in the amount of cooling liquid introduced at one time can render the furnace unusable.

Of course, a slower cooling process is, in general, safer for the furnace. But reducing the rate of cooling also impairs the overall productivity of the furnace, because a longer cooling process means that the furnace is out of service for longer periods of time.

It has been known, in the prior art, to introduce a cooling gas, or even a liquefied gas, into a vacuum furnace to promote cooling. It is necessary that such a cooling gas be relatively inert, because of the likelihood of chemical reaction at the high temperatures in the furnace. Thus, for example, U.S. Pat. No. 3,860,222 shows a cooling system for vacuum furnaces, wherein argon is used as a cooling gas. Similarly, U.S. Pat. No. 3,522,357 discloses a vacuum furnace wherein argon is introduced into the furnace prior to quenching by water or oil. U.S. Pat. Nos. 4,395,832 and 3,565,410 teach the use of nitrogen as the inert gas to be injected into the furnace.

Another process for cooling a furnace and its contents is described in the paper entitled "The Cryogenic Rapid Cooling Process", by Dr. Werner Buecker, prepared for the 8th ASM Heat Treating Conference, Detroit, Sept. 18, 1984, the disclosure of which is incorporated by reference herein. This paper provides a method of cooling which can be used for both continuous and batch-type furnaces, the method including the spraying of liquid nitrogen directly on the object to be cooled. The above-described process is also disclosed in U.S. Pat. No. 4,515,645. The disclosures of the patents cited above are incorporated by reference herein.

The present invention comprises a process and apparatus which significantly reduce the time required to cool a vacuum furnace. The apparatus includes automatic means for regulating the cooling process. Although a cryogenic liquid is employed, in the present invention, to cool the cooling gas, at no time is any cryogenic liquid allowed to enter the furnace itself. The process disclosed herein is also more economical than prior art methods, because it uses a less expensive gas for cooling, to the extent possible.

SUMMARY OF THE INVENTION

The process of the present invention, in its most basic form, comprises two steps. First, a noble gas, such as helium or argon, is introduced into the vacuum furnace, to break the vacuum and provide initial cooling. Next, a non-noble but relatively inert gas, such as nitrogen, is injected into the furnace, replacing the noble gas, to complete the cooling process. The noble gas is continuously supplied to the furnace until the temperature inside the furnace falls below the point at which the non-noble cooling gas reacts with the contents of the furnace.

Both the noble and non-noble gases used in the present process are normally cooled, before they enter the furnace, by a cryogenic liquid. However, the cooling gases are not liquefied. It is an important feature of the invention that no liquid ever enters the furnace.

In contrast with the processes of the prior art, all of the cooling is accomplished by convection. The prior art processes typically use conduction, followed by convection, which is less efficient than the present method.

The invention also comprises apparatus for implementing the above-described process. Helium or argon (or another noble gas) is directed through tubing which is immersed in a bath of cryogenic liquid, and then into the furnace. A temperature sensor continuously measures the temperature in the furnace, and provides input to a temperature controller which determines when to shut off the flow of the noble gas, and to substitute the non-noble gas. The non-noble gas, such as nitrogen, is then directed through the same tubing for cooling, and then into the furnace.

The apparatus also includes means for regulating the flow of the cooling gases, to achieve the desired rate of cooling of the furnace. The apparatus also comprises automatic means for insuring that the cooling gas cannot be liquefied while being cooled, and that no liquid ever contacts directly the interior of the furnace. The apparatus, in the preferred embodiment, includes one or more microprocessors which implement the above-identified features.

It is therefore an object of the present invention to provide a process for rapid cooling of a vacuum furnace.

It is another object to provide a process which improves the productivity of a vacuum furnace.

It is another object to provide a process for rapid cooling of a vacuum furnace, wherein cooling gases are cooled by a cryogenic liquid, but wherein no liquid is permitted to contact directly the interior of the furnace.

It is another object to provide a process for cooling a vacuum furnace, wherein the process is achieved by conduction and convection within the furnace.

It is another object of the invention to provide apparatus for cooling a vacuum furnace.

It is another object to provide apparatus as described above, wherein the rate of cooling of the furnace can be precisely controlled.

It is another object to provide apparatus as described above, wherein the cooling process may be controlled automatically.

It is another object to provide apparatus as described above, wherein one or more microprocessors can be programmed to monitor and control the cooling process.

Other objects and advantages of the invention will be apparent to those skilled in the art, from a reading of the following brief description of the drawings, the detailed description of the invention, and the appended claims.

DETAILED DESCRIPTION OF THE INVENTION

Figure 1:
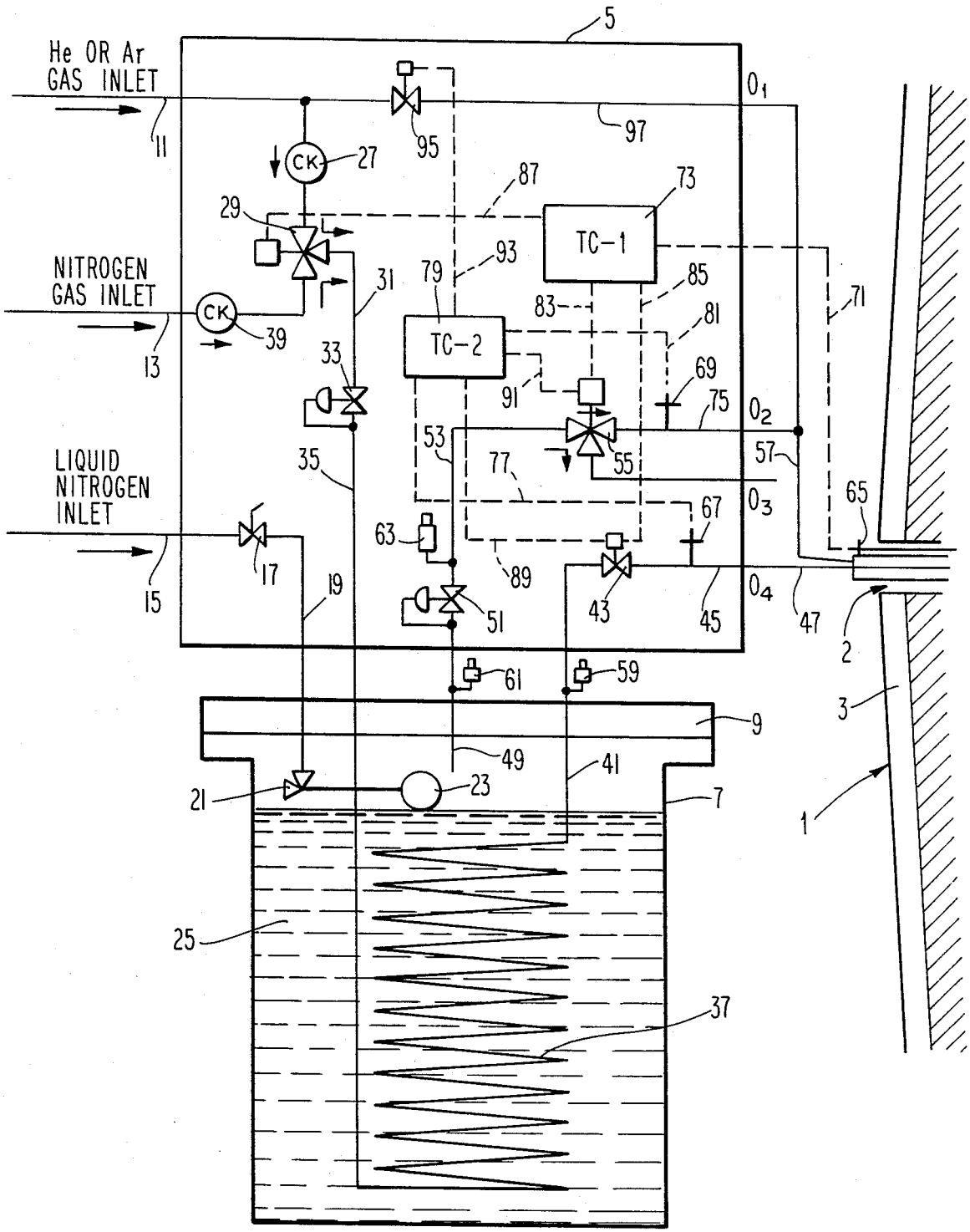
FIG. 1 is a schematic diagram of the apparatus of the present invention.

The present invention is illustrated schematically in FIG. 1. The invention is intended to cool vacuum furnace 1, having exterior wall 3, is partially visible in the figure. The furnace has a gas outlet 2. A check valve (not shown) inside the furnace prevents gas from entering the furnace through outlet 2.

Box 5 is a schematic representation of the grouping of the components of the invention, in one possible arrangement. However, it is understood that other arrangements of components may be used. The apparatus shown within box 5 works in conjunction with the components shown below, including insulated container 7 having lid 9.

The cooling apparatus has three inlets, designated by reference numerals 11, 13, and 15. These inlets are labeled as entry points for helium or argon gas, for nitrogen gas, and for liquid nitrogen, respectively, and the invention will be described in connection with these substances. However, it is understood that the invention can be used with noble gases other than helium or argon, and with relatively inert gases other than nitrogen. What is important is that a noble gas be introduced at inlet 11, and that a gas which is at least relatively inert be introduced at inlet 13. Furthermore, virtually any cryogenic liquid may be injected at inlet 15. The liquid entering at inlet 15 need not be the liquefied form of the gas entering at inlet 13, although the system would require some modification, as explained below, to accommodate this possibility.

The gases entering the system at inlets 11 and 13 are preferably kept at pressures which are sufficient to prevent the gases from becoming liquids at their respective temperatures. If liquid nitrogen is to be the liquid in the bath, the pressure in the bath should be of the order of 50 psia, so as to maintain a temperature in the bath of about −300° F. As stated above, other liquids besides nitrogen can be used to constitute the bath, and, in general, these liquids can be kept at pressures of about 70 psia or less, as these pressures are usually adequate to maintain a suitable temperature in the bath for cooling the gas passing through tubing 37.

Liquid nitrogen entering the system through inlet 15 passes through manually-operated shutoff valve 17, through conduit 19, and into container 7, through float valve 21. Float valve 21 is connected to float ball 23. The float valve and float ball together regulate the level of the liquid 25 in the container. Valve 21 may be a proportional valve, allowing varying amounts of liquid into the container, according to the amount of deviation of float ball 23 from its equilibrium position.

Helium or argon enters the system at inlet 11, and passes through check valve 27, and into electrically operated valve 29. Valve 29 is configured to allow either gas from inlet 11 or inlet 13 to pass through, but not both at the same time. Valve 29 directs one of these incoming gas streams into conduit 31. The gas can then flow through pressure regulating valve 33, and through conduit 35. Conduit 35 is connected directly to fin tubing 37. The gas flowing through conduit 35 and tubing 37 never contacts the liquid 25 in container 7.

Pressure regulating valve 33 can be a spring biased valve which regulates the pressure in the line, over a relatively narrow range.

Nitrogen gas enters the system through inlet 13, passing through check valve 39, and into electrically operated valve 29. The nitrogen will enter conduit 31 if valve 29 has been switched to allow nitrogen gas into the system.

The gas flowing through the tubing 37 is cooled by the liquid 25 in the container, and flows out of the container through conduit 41. The cooled gas flows through electrically operated valve 43, through conduit 45, and out of the system at outlet $O_4$, and through conduit 47 and into the furnace.

Nitrogen gas formed from vaporization of the liquid 25 is withdrawn from the container through conduit 49. The gas flows through pressure regulating valve 51, through conduit 53, and into electrically operated valve 55. Valve 55 allows the gas either to vent to the atmosphere through outlet $O_3$, or to exit the system at outlet $O_2$ and to enter the vacuum furnace through conduit 57.

Conduits 41 and 49 communicate with pressure relief valves 59 and 61. Conduit 53 also communicates with pressure relief valve 63. Valve 61 is set to relieve pressure buildup in container 7, and is set to open at pressures higher than the operating pressure for valve 51. Valve 59 is set to relieve pressure buildup in the tubing 37, and is set to open at pressures higher than the operating pressure for valve 33.

The temperature in the vacuum furnace is measured by temperature sensor 65. Sensor 65 may be a conventional thermocouple, or other temperature measuring device. The output of sensor 65 is directed to a temperature controller, shown in block 73 and labeled TC-1, the control being indicated by dotted line 71.

Similarly, temperature sensor 67 measures the temperature in conduit 45, and is connected, as indicated by dotted line 77, to another temperature controller, shown in block 79 and labeled TC-2. Temperature sensor 69 measures the temperature in conduit 75, and is also connected, as shown by dotted line 81, to temperature controller TC-2.

The temperature controllers TC-1 and TC-2 may be microprocessors, having conventional analog-to-digital and digital-to-analog converters associated therewith. It is understood, however, that the functions of the temperature controllers could be performed by purely mechanical means. The functions of the temperature controllers could also be performed manually.

The outputs of temperature controller TC-1 are indicated by dotted lines 83, 85, and 87. The controller TC-1 thus controls the position of valve 43, and of electrically operated valves 55 and 29.

The outputs of temperature controller TC-2 are indicated by dotted lines 89, 91, and 93. The controller TC-2 also controls the position of valve 43, and of electrically operated valve 55. Controller TC-2 also controls valve 95, which allows gas from inlet 11 to flow through conduit 97 and through outlet $O_1$.

The operation of the system will now be described. It is assumed, in the description that follows, that the gas entering the system at inlet 11 is argon, and that the gas entering at inlet 13 is nitrogen. Other gases can be used, subject to the conditions stated above.

When it is desired to begin cooling the vacuum furnace, temperature controller TC-1 opens electrically operated valve 29 to allow argon gas to flow through valve 29 and into conduit 31. Valve 95 is normally closed, and will be opened only under the special conditions to be described below. The pressure of the argon is regulated by pressure regulator 33, and the gas passes through conduit 35 and tubing 37, where it is cooled by the liquid nitrogen 25.

Temperature controller TC-1 then simultaneously monitors the output of temperature sensor 65 and controls the position of electrically operated valve 43, so as to regulate the drop of temperature in the furnace. Controller TC-1 is programmed to maintain a predetermined rate of temperature drop inside the furnace. By opening valve 43, controller TC-1 can reduce the temperature in the furnace, by admitting more cold gas. Conversely, the controller can halt the temperature reduction by closing valve 43. In the preferred embodiment, there is a first, predetermined rate of temperature drop, above which the flow of cooled gas into the furnace will be halted, and a second predetermined rate below which the flow of cooled gas will be resumed.

It is also possible that the rate of temperature drop can be programmed to change over time, according to the absolute level of the temperature at any given time. The microprocessor can simply substitute new values for the above-described first and second predetermined rates, depending on the temperature level at a particular time.

Controller TC-1 also controls the rate of cooling by operating valve 55. When it is necessary to reduce the amount of cooled nitrogen gas entering the furnace, the position of valve 55 is switched so as to cause the gas to vent to the atmosphere, through outlet $O_3$.

Stored in the memory of temperature controller TC-1 is the temperature below which the contents of the furnace will not react with nitrogen. This temperature is known as the critical temperature. When the critical temperature is reached, it is no longer necessary to cool the furnace with relatively expensive argon, and controller TC-1 thus effects the change from argon to nitrogen as the cooling gas. Electrically operated valve 55, which had been in the closed position, is opened to allow nitrogen gas, which has evaporated from the liquid 25, to enter the furnace. In addition, electrically operated valve 29 is switched, so that nitrogen from inlet 13 flows into conduit 31 and into the container 7, instead of the argon from inlet 11. Thus, nitrogen replaces argon as the cooling gas, after the temperature in the furnace falls below the critical temperature.

The apparatus thus maximizes the use of nitrogen, which is less expensive than argon, to the extent practical. Only while the temperature in the furnace is still extremely high is it necessary to use a noble gas, to prevent unwanted chemical reactions.

It is essential that no liquid enter the furnace. Otherwise, the contents of the furnace are likely to be damaged or warped by the sudden temperature change. To prevent liquid from entering, by reason of a malfunction in the system, controller TC-2 monitors the ouputs of temperature sensors 67 and 69, and if the sensed temperatures approach that of liquid nitrogen, controller TC-2 opens electrically operated valve 95, thereby causing argon gas from inlet 11 to enter the furnace directly, without being cooled. Controller TC-2 simultaneously closes valves 55 and 43, so that liquid cannot enter the furnace. The argon gas, flowing out of the system at outlet $O_1$, continues the cooling process. Although the argon is not near cryogenic temperatures, it is still cool in comparison with the interior of the furnace.

Pressure regulating valve 51 is set to maintain the pressure of the gas exiting the container through conduit 49 at a level below that of valve 33. This setting prevents the liquefaction of the gas flowing through the tubing 37.

As stated above, the liquid level in container 7 is maintained by float valve 21 and float ball 23. The level is not critical, but it is preferable that the fin tubing 37 be submerged in the liquid, for maximum cooling of the gas.

Figure 3:
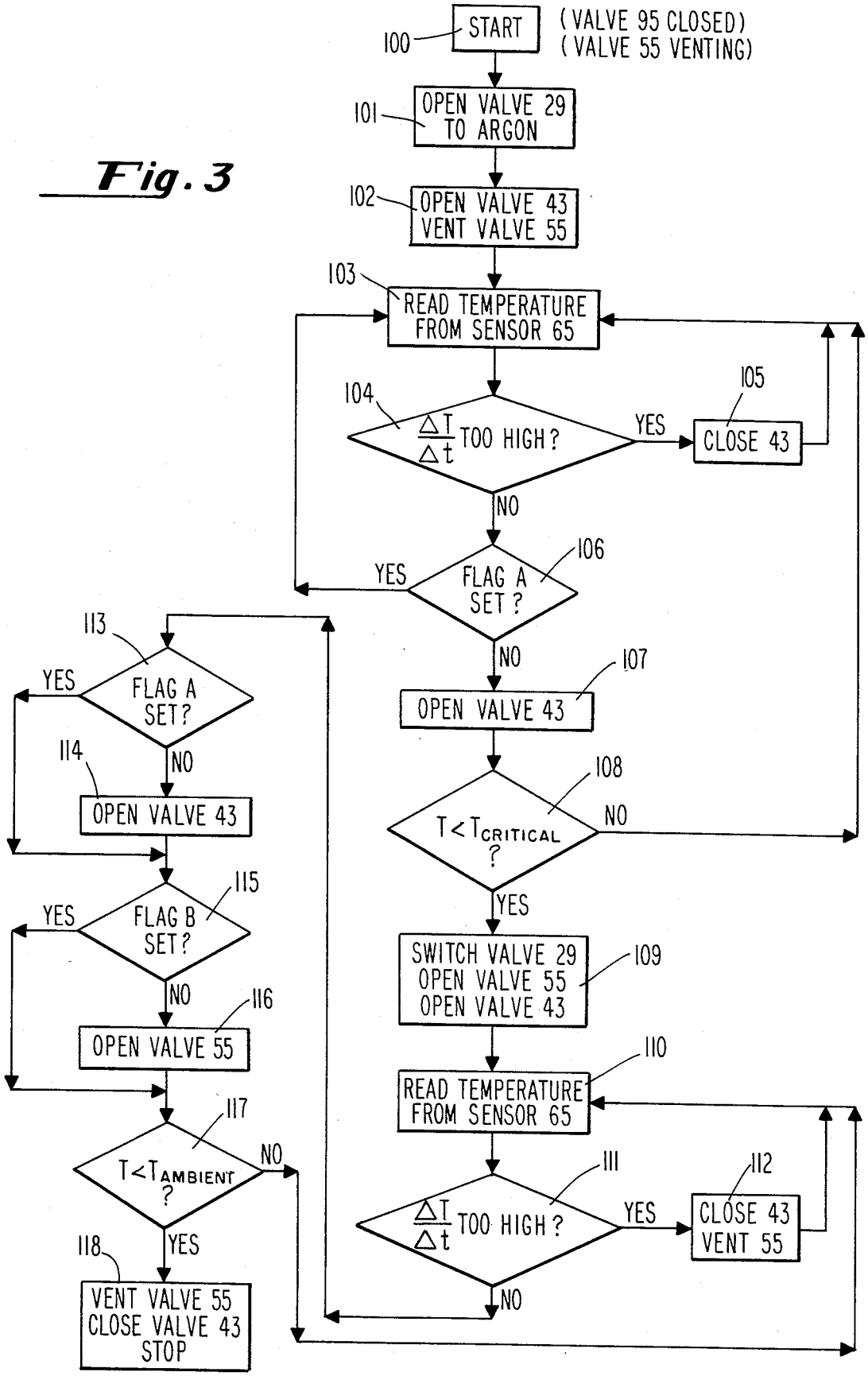
FIG. 3 is a flow chart showing the programming logic for temperature controller TC-1 in FIG. 1, according to one embodiment of the invention.
Figure 4:
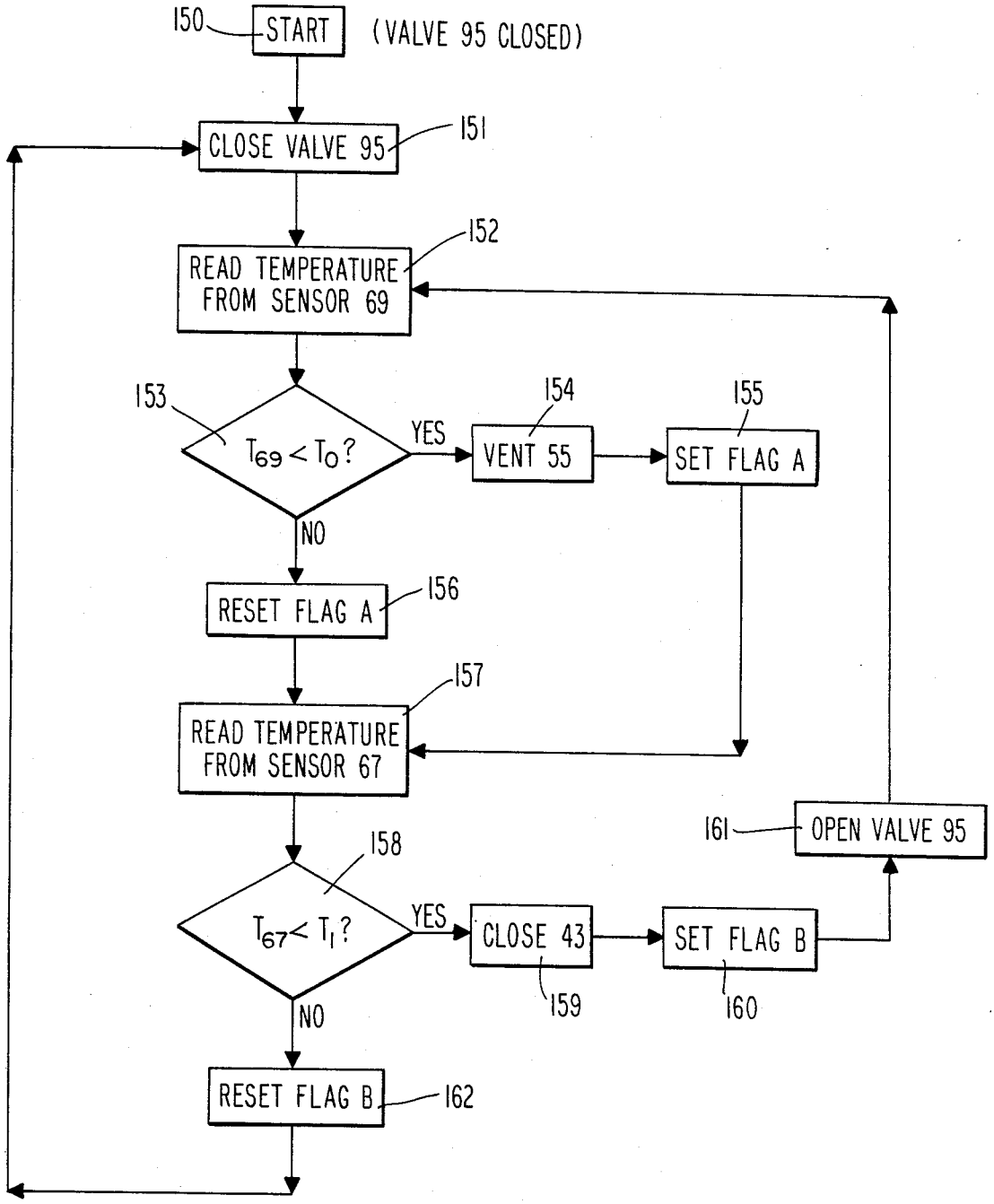
FIG. 4 is a flow chart illustrating the programming logic for temperature controller TC-2 in FIG. 1, according to one embodiment of the invention.

The programming for the temperature controllers TC-1 and TC-2 is illustrated, in one possible embodiment, in FIGS. 3 and 4. FIG. 3 is a flow chart showing the programming of controller TC-1; FIG. 4 is a flow chart for controller TC-2. It is possible that the functions of both controllers could be performed by one microprocessor. The division of functions into two blocks in FIG. 1 is for purposes of clarity. If only one microprocessor is used, then the flow charts of FIGS. 3 and 4 would be merged into one program. It is also understood that many variations of the programming logic can be used, within the scope of this invention.

The operation of controller TC-1 is as follows. The program starts in block 100 with valve 95 closed, and with valve 55 in the venting position. Also, valve 43 is closed. In this initial state, no gas or liquid can leave the system. Any gas in tubing 37 is blocked by valve 43, and any gas leaving container 7 through conduit 49 is vented through outlet $O_3$. It is understood that if the microprocessor issues a command to open or close a valve that is already open or closed, then the valve simply stays in its same position.

In block 101, valve 29 is opened so as to allow argon from inlet 11 to flow towards the container. Valve 43 is opened in block 102, but valve 55 is maintained in the venting position. Thus, the system allows cooled argon to exit at outlet $O_4$. At this stage, no gas from conduit 49 can be allowed into the furnace, because the gas in conduit 49 is nitrogen, not argon.

Temperature controller TC-1 next reads the temperature from sensor 65, in block 103. It is understood that controller TC-1 has an internal clock, enabling the controller to measure the rate of change in the temperature. In test 104, the controller compares the measured rate of temperature drop with a previously stored value. If the temperature is changing too rapidly, the controller closes valve 43, in block 105, and returns to block 103 to read the temperature again.

If the rate of change in the temperature is not too great, the controller must open valve 43. Before it can do so, the program checks the status of Flag A, in test 106. Flag A is an inhibiting signal which comes from controller TC-2, to be described below. If the flag is set, the program returns to block 103 to read the temperature again. If Flag A is not set, the controller opens valve 43 in block 107.

The controller next tests, in test 108, whether the sensed temperature, from sensor 65, is below the critical temperature, i.e. the temperature above which nitrides can form. If the temperature is still above the critical level, the program returns to block 103, and repeats the procedure described above.

If the temperature has fallen below the critical level, the system, in block 109 switches the position of valve 29, so that valve 29 now allows only nitrogen, from inlet 13, to enter the container. The controller also opens valves 55 and 43.

The controller next reads the temperature from sensor 65, in block 110. In test 111, the controller decides whether the rate of change in temperature is too great. If so, valve 43 is closed and valve 55 is switched to the venting position, in block 112, and the program returns to block 110.

If the rate of temperature drop is not too high, the controller then checks the status of Flag A, in test 113. If Flag A is not set, the controller opens valve 43, in block 114. If Flag A is set, the program bypasses block 114. The program then checks the status of Flag B, another inhibitory flag, to be described below. If the flag is not set, the program opens valve 55, in block 116. If the flag is set, the program bypasses block 116.

In test 117, the controller tests whether the temperature at sensor 65 is less than ambient temperature. If not, the program returns to block 110 to read the temperature again, and to repeat the steps shown in FIG. 3. If the temperature has reached the ambient level, then the program switches valve 55 to the venting position, closes valve 43, and stops.

FIG. 4 illustrates the programming logic for temperature controller TC-2. The program starts in block 150, valve 95 being closed. In block 151, valve 95 is closed (this step being redundant but harmless if the valve is already closed). In block 152, the program reads the temperature from sensor 69. This temperature is compared, in test 153, with $T_0$, a previously stored value which represents a temperature slightly above the temperature at which the gas in conduit 75 can be liquefied, at the given level of pressure. If the measured temperature is less than $T_0$, the program proceeds to block 154, wherein valve 55 is switched to its venting position. Flag A is then set in block 155, and the program continues in block 157. Thus, Flag A will be set whenever the temperature in conduit 75 drops to a level dangerously close to that at which a cryogenic liquid might enter the furnace.

If the temperature at sensor 69 is not dangerously low, Flag A is reset in block 156, cancelling any prior setting of that flag.

In block 157, the controller reads the temperature from sensor 67, and tests this temperature against a previously stored value $T_1$ in test 158. If the measured temperature is less than $T_1$, the controller closes valve 43, in block 159, and sets Flag B, in block 160. The program then opens valve 95, in block 161, allowing argon to flow directly into the furnace, and the program returns to block 152.

If the temperature at sensor 67 is not too low, then Flag B is reset, in block 162. This action cancels any previous set position of that flag. The program then returns to block 151, and repeats the operations described above.

Controller TC-2 thus generates two flags, which are used as inputs to controller TC-1. In this manner, TC-2 can override any decision by TC-1 to open valves 43 or 55. TC-1 cannot open valves 43 or 55 unless the respective flags are not set. Thus, TC-1 cannot inadvertently allow a cryogenic liquid, or near liquid, to enter the vacuum furnace.

As stated above, it is possible that the cryogenic liquid in the container is not the same substance as the gas entering through inlet 13. If this is true, then it is necessary to make one of two modifications to the apparatus. First, conduit 49 and its associated components could be deleted, and replaced with a simple venting means. That is, the vaporized liquid would not be allowed to enter the furnace. Alternatively, if it is desired to use the vaporized liquid as an additional cooling gas, then a separate control means would be needed to insure that such gas does not enter the furnace when the furnace temperature is above the critical temperature for such gas. Clearly, it is simpler to use the same material for the gas entering inlet 13 and the liquid in the container.

In using the present invention, argon is typically introduced into the vacuum furnace when its temperature is about 2000° F. or higher. Below the critical temperature, about 1000° F., nitrogen is used to complete the cooling, until the temperature has been reduced to approximately 200° F.

Figure 2:
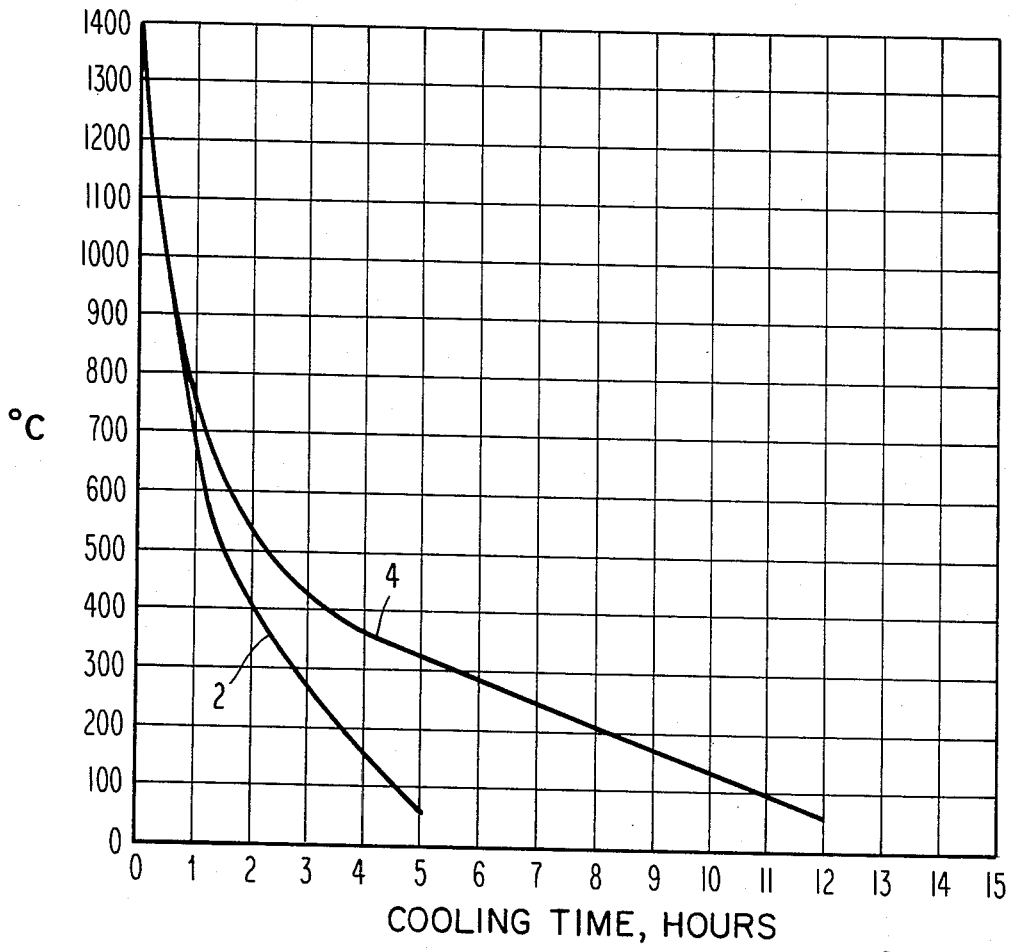
FIG. 2 is a graph illustrating the cooling rate achievable with the present invention, in comparison with the rate for processes of the prior art.

FIG. 2 illustrates the relative benefits of the present invention, in comparison with processes of the prior art. FIG. 2 is a graph showing the temperature in a vacuum furnace as a function of time. Curve 4 represents the typical cooling characteristics of prior art processes. Curve 2 represents the operation of the present invention. The difference between these curves is considerable. The time required to cool the furnace to ambient temperature is reduced by almost two thirds.

It is clear that the objects of the invention are fulfilled by the above disclosure. It is understood that the invention can be modified in many ways. The programming illustrated for the microprocessors can be accomplished differently. The microprocessors can be configured as one unit. Or, the temperature control functions could be performed by mechanical, or even manual means. The choice of gases used is not critical, subject to the limitations discussed above. These and other modifications are to be deemed within the spirit and scope of the following claims.

What is claimed is:

1. Apparatus for cooling a vacuum furnace, comprising:

(a) first means for injecting a first cooling gas into the furnace, (b) second means for injecting a second cooling gas into the furnace, (c) means for cooling said first and second cooling gases before injection into the furnace, (d) means for sensing the rate of change of temperature in the furnace, the sensing means being connected to a control means, the control means being operatively connected to the first and second injecting means, the control means being adapted to select the first or second cooling gas for injection into the furnace, and (e) means for venting said first or second cooling gases out of the furnace, wherein both of said first and second cooling gases are directed through the cooling means, into the furnace, and out of the furnace, in a non-recirculating path.

2. The apparatus of claim 1, wherein the control means comprises a microprocessor and at least one electrically operated valve means, the valve means being adapted to direct either of said first or second cooling gases into the apparatus, upon receiving a signal from the microprocessor.

3. The apparatus of claim 2, further comprising means for stopping the flow of cooled gas into the furnace when the rate of temperature drop inside the furnace exceeds a first predetermined level, and for resuming the flow of cooled gas into the furnace when the rate of temperature drop inside the furnace falls below a second predetermined level.

4. The apparatus of claim 3, wherein the cooling means comprises an insulated container, the container being filled with a cryogenic liquid, a length of tubing submerged in the cryogenic liquid, the tubing being connected at one end to receive one of said first or second cooling gases, and connected at the other end to direct said gases into the furnace.

5. The apparatus of claim 4, further comprising means for maintaining the level of cryogenic liquid in the container.

6. The apparatus of claim 4, further comprising means for monitoring the temperature of the cooled gas entering the furnace, and means for closing off the flow of said gas when its temperature approaches the level at which the gas becomes a liquid.

7. The apparatus of claim 6, further comprising means for directing said first cooling gas directly into the furnace, without passing through the container.

8. The apparatus of claim 7, wherein the cryogenic liquid is the liquefied form of the second cooling gas, and wherein the container comprises conduit means for collecting vaporized liquid within the container, and directing said vaporized liquid into the furnace.

9. Apparatus for cooling a vacuum furnace, comprising:

(a) inlet means for a noble gas, (b) inlet means for a non-noble gas, (c) insulated container means for storing a bath of the liquefied form of the non-noble gas, (d) conduit means submerged in the container, one end of the conduit means being connected to a valve means for selecting either the noble or the non-noble gas for injection into the conduit means, the valve means being connectable to either of said inlet means, the other end of the conduit means communicating with the interior of the furnace, (e) means for sensing the temperature inside the furnace and for closing off the conduit means when the rate of temperature drop inside the furnace exceeds a predetermined value, (f) means for measuring the temperature in the conduit means and for stopping the flow of gas through the conduit means when the temperature approaches the level at which the gas becomes a liquid, and (g) means for venting said noble or non-noble gases out of the furnace, wherein both of said noble and non-noble gases are directed through the cooling means, into the furnace, and out of the furnace, in a non-recirculating path.

10. The apparatus of claim 9, further comprising means for directing said noble gas directly into the furnace, without passing through the container means.

11. The apparatus of claim 10, wherein the noble gas is selected from the group consisting of helium and argon.

12. The apparatus of claim 11, wherein the non-noble gas is nitrogen.

13. The apparatus of claim 12, including means for regulating the pressure in the conduit means.

14. The apparatus of claim 13, wherein the bath occupies less than the entire space within the container means, and wherein the apparatus comprises means for withdrawing vaporized liquid within the container means and for directing said vaporized liquid into the furnace.

15. The apparatus of claim 14, further comprising means for closing off the flow of said vaporized liquid into the furnace when the temperature of the vaporized liquid approaches the level at which it returns to the liquid state.

16. The apparatus of claim 15, wherein the sensing means is also adapted to stop the flow of vaporized liquid through the withdrawing means, when the rate of temperature drop in the furnace exceeds said predetermined value.

17. Apparatus for cooling a vacuum furnace, comprising:

(a) first means for injecting a first cooling gas into the furnace, (b) second means for injecting a second cooling gas into the furnace, (c) means for cooling said first and second cooling gases before injection into the furnace, and (d) means for sensing the rate of change of temperature in the furnace, the sensing means being connected to a control means, the control means being operatively connected to the first and second injecting means, the control means being adapted to select the first or second cooling gas for injection into the furnace, wherein the control means comprises a microprocessor and at least one electrically operated valve means, the valve means being adapted to direct either of said first or second cooling gases into the apparatus, upon receiving a signal from the microprocessor, the apparatus further comprising means for stopping the flow of cooled gas into the furnace when the rate of temperature drop inside the furnace exceeds a first predetermined level, and for resuming the flow of cooled gas into the furnace when the rate of temperature drop inside the furnace falls below a second predetermined level, wherein the cooling means comprises an insulated container, the container being filled with a cryogenic liquid, a length of tubing submerged in the cryogenic liquid, the tubing being connected at one end to receive one of said first or second cooling gases, and connected at the other end to direct said gases into the furnace, the apparatus further comprising means for maintaining the level of cryogenic liquid in the container, means for monitoring the temperature of the cooled gas entering the furnace, means for closing off the flow of said gas when its temperature approaches the level at which the gas becomes a liquid, and means for directing said first cooling gas directly into the furnace, without passing through the container, wherein the cryogenic liquid is the liquefied form of the second cooling gas, and wherein the container comprises conduit means for collecting vaporized liquid within the container, and directing said vaporized liquid into the furnace.

18. Apparatus for cooling a vacuum furnace comprising:

(a) inlet means for a noble gas, (b) inlet means for a non-noble gas, (c) insulated container means for storing a bath of the liquefied form of the non-noble gas, (d) conduit means submerged in the container, one end of the conduit means being connected to a valve means for selecting either the noble or the non-noble gas for injection into the conduit means, the valve means being connectable to either of said inlet means, the other end of the conduit means communicating with the interior of the furnace, (e) means for sensing the temperature inside the furnace and for closing off the conduit means when the rate of temperature drop inside the furnace exceeds a predetermined value, (f) means for measuring the temperature in the conduit means and for stopping the flow of gas through the conduit means when the temperature approaches the level at which the gas becomes a liquid, the apparatus further comprising means for directing said noble gas directly into the furnace, without passing through the container means, wherein the noble gas is selected from the group consisting of helium and argon, and wherein the non-noble gas is nitrogen, and further including means for regulating the pressure in the conduit means, wherein the bath occupies less than the entire space within the container means, and wherein the apparatus comprises means for withdrawing vaporized liquid within the container means and for directing said vaporized liquid into the furnace.

19. The apparatus of claim 18, further comprising means for closing off the flow of said vaporized liquid into the furnace when the temperature of the vaporized liquid approaches the level at which it returns to the liquid state.

20. The apparatus of claim 19, wherein the sensing means is also adapted to stop the flow of vaporized liquid through the withdrawing means, when the rate of temperature drop in the furnace exceeds said predetermined value.

* * * * *